US005886609A

United States Patent [19]

Stelter

[11] Patent Number: 5,886,609

[45] Date of Patent: Mar. 23, 1999

[54] SINGLE DIPOLE PERMANENT MAGNET STRUCTURE WITH LINEAR GRADIENT MAGNETIC FIELD INTENSITY

[75] Inventor: Richard E. Stelter, Livermore, Calif.

[73] Assignee: Dexter Magnetic Technologies, Inc., Fremont, Calif.

[21] Appl. No.: 955,096

[22] Filed: Oct. 22, 1997

[51] Int. Cl.[6] ..... H01F 7/02

[52] U.S. Cl. ..... 335/306; 335/296

[58] Field of Search ..... 315/5.34, 5.35; 335/296–306

[56] References Cited

U.S. PATENT DOCUMENTS

| | | |
|---|---|---|
| Re. 33,736 | 11/1991 | Clarke . |
| 4,549,155 | 10/1985 | Halbach . |
| 4,592,889 | 6/1986 | Leupold et al. . |
| 4,647,887 | 3/1987 | Leupold . |
| 4,654,618 | 3/1987 | Leupold . |
| 4,692,732 | 9/1987 | Leupold et al. . |
| 4,701,737 | 10/1987 | Leupold . |
| 4,764,743 | 8/1988 | Leupold et al. . |
| 4,810,986 | 3/1989 | Leupold . |
| 4,831,351 | 5/1989 | Leupold et al. . |

(List continued on next page.)

OTHER PUBLICATIONS

Herbert A. Leupold and Ernest Potenziani II: *An Overview of Modern Permanent Magnet Design;* Research and Development Technical Report SLCET–TR–90–6; Aug. 1990.

Rollin J. Parker; *Advances in Permanent Magnetism;* John Wiley & Sons, Copyright 1990.

Lester R. Moskowitz; Permanent Design and Application Handbook; Cahners Books International, Inc., Copyright 1976.

*Primary Examiner*—Lincoln Donovan

*Attorney, Agent, or Firm*—Blakely Sokoloff Taylor & Zafman, LLP

[57] ABSTRACT

A dipole permanent magnet structure having a rectangular gap about a longitudinal axis, in which tapered pole pieces form opposing sides of the rectangular gap to permit establishing a magnetic field in the gap. Permanent magnets having a rectangular shape are coupled to the rear, or base, of each pole piece, and have a magnetic field oriented in the same direction as the pole pieces, perpendicular to longitudinal axis, thereby establishing a magnetic field between the pole pieces. Additional permanent magnets, including a pair of blocking magnets, are coupled to the aforementioned permanent magnets to form a magnetic circuit. The orientation of the magnetic field of each permanent magnet is generally aligned in the direction of the lines of flux in the magnetic circuit to maximize the flux density within the air gap created by formation of the permanent magnets. Moreover, the pair of blocking magnets each form an opposing side of the rectangular gap adjacent to the pole pieces to prevent fringing. The pole pieces and blocking magnets are tapered along the longitudinal axis such that the rectangular gap narrows from the proximate end to the distal end of the gap. The structure is thus capable of generating a magnetic field having a linear range of flux densities from a relatively low flux density to a flux density greater than the residual flux density of the magnet material. Indeed, the gap flux density is limited only by the saturation flux density of the pole pieces. Thus, the permanent magnets can be made of magnet material having high coercivity and high saturation magnetization level. An embodiment of the magnet structure is capable of generating a magnetic field in the air gap having a flux density range of 0.5 Tesla or less to 2.0 Tesla or more.

34 Claims, 11 Drawing Sheets

U.S. PATENT DOCUMENTS

| | | | |
|---|---|---|---|
| 4,835,137 | 5/1989 | Leupold . | |
| 4,835,506 | 5/1989 | Leupold . | |
| 4,839,059 | 6/1989 | Leupold . | |
| 4,859,973 | 8/1989 | Leupold . | |
| 4,859,976 | 8/1989 | Leupold . | |
| 4,861,752 | 8/1989 | Leupold . | |
| 4,862,126 | 8/1989 | Leupold . | |
| 4,862,128 | 8/1989 | Leupold . | |
| 4,887,058 | 12/1989 | Leupold . | |
| 4,893,103 | 1/1990 | Leupold . | |
| 4,894,360 | 1/1990 | Leupold . | |
| 4,911,627 | 3/1990 | Leupold . | |
| 4,917,736 | 4/1990 | Leupold . | |
| 4,928,081 | 5/1990 | Leupold . | |
| 4,953,555 | 9/1990 | Leupold . | |
| 4,994,777 | 2/1991 | Leupold et al. . | |
| 4,994,778 | 2/1991 | Leupold . | |
| 5,014,028 | 5/1991 | Leupold . | |
| 5,028,902 | 7/1991 | Leupold et al. . | |
| 5,034,715 | 9/1994 | Leupold et al. | 335/306 |
| 5,041,419 | 8/1991 | Leupold . | |
| 5,055,812 | 10/1991 | Abele et al. . | |
| 5,063,004 | 11/1991 | Leupold . | |
| 5,072,204 | 12/1991 | Leupold . | |
| 5,075,662 | 12/1991 | Leupold et al. . | |
| 5,162,771 | 11/1992 | Abele . | |
| 5,347,254 | 9/1994 | Leupold | 335/306 |

SINGLE DIPOLE PERMANENT MAGNET STRUCTURE WITH LINEAR GRADIENT MAGNETIC FIELD INTENSITY

BACKGROUND OF THE INVENTION

1. Field of the Invention

The present invention relates to the field of permanent magnets. More specifically, the present invention relates to the field of multipole or dipole permanent magnet (PM) structures for generating an intense magnetic field in a gap using a minimal volume of magnet material for the permanent magnet structure, wherein the magnetic field intensity in the gap varies according to a substantially linear gradient along the longitudinal axis of the gap.

2. Description of the Related Art

Introduction

The present invention relates to a configuration of a plurality of permanent magnets to produce a permanent magnet (PM) structure capable of generating in an aperture or gap formed by the permanent magnets a magnetic field having a high flux density that varies in a substantially linear manner along the longitudinal axis of the gap.

The performance of a permanent magnet depends on the magnet itself and the environment in which it operates. Advances in permanent magnetism have had a large impact on the number of applications for which permanent magnets may now be used or considered. Advances in such areas as magnet material (for example, rare earth magnet materials), magnet size, and magnet structure have combined to produce permanent magnets having internal magnetic fields with very high flux densities, for example, above 1.4 Tesla (14,000 Gauss). Indeed, today the properties exhibited by permanent magnets offer compelling reasons to use permanent magnets over electromagnets.

Electromagnets can produce quite large magnetic fields by driving electrical current through a coil of electrically conductive wire. However, the size and expense of such electromagnets, as well as power supply requirements and heat dissipation problems, make electromagnets unattractive for applications requiring an intense magnetic field in a physically small space.

Permanent magnets are used in applications that exploit the permanent magnet's unique capability to provide a force, or perform work of some kind without contact. In order for a permanent magnet to perform work, it must generate a magnetic field external to itself. Typically, the object upon which the permanent magnet operates is placed or passes through an aperture or air gap, or simply, gap, in the magnetic circuit formed by the permanent magnetic structure. The greater the strength of the magnetic field capable of being generated by the permanent magnet structure in the gap, the greater the permanent magnet's ability to perform work. To that end, research has focused on techniques to improve the efficiency of the magnetic circuit formed by the permanent magnet structure so as to maximize the strength of the magnetic field in the gap while minimizing the volume of magnet material required.

There are many prior art permanent magnet structures, from the ubiquitous C-shaped dipole permanent magnet to complex multipole permanent magnet structures designed for highly specific applications, for example, synchrotron radiation, or the operation of free electron lasers. Yet some applications, such as spectrometers based on exploiting the Zeeman effect, or the field of power generation known as magnetohydrodynamics, require magnetic field intensities unattainable within the design limitations imposed by such applications using prior art permanent magnet structures due substantially to leakage flux and fringing flux, as briefly described below.

Leakage and Fringing Flux

A brief overview of prior art permanent magnet structures and their limitations with respect to leakage flux and fringing flux is beneficial for understanding the present invention.

An efficient design of a permanent magnet should minimize the effects of leakage flux and fringing flux. Minimizing leakage flux and fringing flux can be accomplished by recognizing and accommodating in the design of the permanent magnet structure the following principles:

1. Magnetic lines of force (flux lines) follow the path of least reluctance (the reciprocal of permeance). Thus, for example, flux lines will generally flow more easily through ferromagnetic materials than air because, as is well known, ferromagnetic materials have a higher permeance than air.
2. Flux lines flowing in the same direction repel one another. Thus, magnetic lines of force tend to diverge as they move away from a magnetic pole rather than converge or remain parallel.
3. Flux lines always form closed loops and cannot, therefore, intersect.
4. Flux lines represent a tension along their length which tends to make them as short as possible. Thus, given that flux lines also form closed loops, they always form curved lines from the nearest north pole to the nearest south pole in a path that forms a complete closed loop. It should be noted that flux lines do not necessarily pass from the north pole to the south pole of the same magnet, but may go from the north pole of a first magnet to the south pole of a second magnet that is either physically closer to the north pole of the first magnet or there is a lower reluctance path from the north pole of the first magnet to the south pole of the second magnet than the path from the north pole to the south pole of the first magnet.
5. In a magnetic circuit, any two points of equal distance from a neutral axis essentially function as poles, wherein flux lines exist between them.

Keeping the above principles in mind, and with reference to FIG. 1, a permanent magnet structure 100 is illustrated in which permeable pole pieces 102 and 103 (which may be made of, for example, mild steel), permanent magnet 101, and air gap 104 form a magnetic circuit. Fringing flux near air gap 104 passes around the air gap, as illustrated by flux lines 105, primarily because of principles (1) and (2) above, rather than directly through the air gap, as illustrated by flux lines 107. Leakage flux, as illustrated by flux lines 106, flows between pole pieces 102 and 103 and across the back of the magnetic circuit from the north pole to the south pole of magnet 101, primarily because of principles (1), (4) and (5) discussed above.

As illustrated in FIG. 1, the total flux directly through the air gap is less than the total flux in the magnetic circuit formed by permanent magnet structure 100 because of the effects of fringing flux and leakage flux. The magnetic field intensity (H) present in air gap 104 is directly related to the number of lines of flux, i.e., the flux density (B), within air gap 104, based on the equation:

$$H=\mu B$$

where $\mu$ is the permeability of, in this case, air (a constant). Thus, the greater the number of lines of flux passing directly through the air gap, i.e., the greater the flux density (B) in the air gap, the greater the magnetic field intensity (H) in the air gap.

Techniques that minimize fringing flux and leakage flux improve the efficiency of the magnetic circuit formed by a permanent magnet structure by increasing the magnetic field intensity (H) in the air gap where it is desired in order to perform work. FIGS. 2(*a*), (*b*), (*c*), and (*d*) illustrate four prior art methods of minimizing leakage flux. FIG. 2(*a*) illustrates optimizing the shape of the permanent magnet. Magnet 201 is optimized to minimize leakage flux occurring in magnet 200. FIG. 2(*b*) illustrates optimizing the location of permanent magnets within a magnetic circuit. While magnet 211 is an improvement over magnet 210, magnet 212 is the best configuration for reducing leakage flux. FIG. 2(*c*) demonstrates using blocking poles or blocking magnets to reduce leakage flux in the area in which the blocking pole is placed. The use of blocking poles is based on the principle that flux lines from like poles repel each other. Thus, leakage that may occur across the inside area of horseshoe magnet 220 is minimized by inserting a bar magnet 221 (having, importantly, a magnetic orientation opposite to magnet 220, with like poles abutting, thereby providing a counter magnetomotive force) in the inside area formed by magnet 220. The same principle applies to the placement of blocking magnets 223 and 224 about bar magnet 222—the presence of properly oriented permanent magnets at the appropriate position in the magnetic circuit reduce leakage flux and, as a result, increase flux density where desired, e.g., in an air gap. Finally, FIG. 2(*d*) illustrates optimizing the magnetic field orientation, i.e., aligning the magnetic lines of force with respect to the physical dimensions of the permanent magnet 231 to achieve a more efficient magnetic circuit than in the case of magnet 230.

Notwithstanding the above methods for reducing leakage flux and fringing flux, the flux density of the external magnetic field in the air gap is still limited by the leakage of flux to some fraction of the intrinsic flux density of the magnet material used. To increase the flux density in the gap, it is well known to those of skill in the relevant art to collect and concentrate the available flux in the circuit by using permeable pole pieces, which may be tapered in the direction of the air gap. Generally, the permeance of an air gap is directly proportional to the area of the gap and inversely proportional to the length of the gap. Increasing the air gap area or, more preferably, reducing the length of the gap will increase the permeance of the gap. The tapering of the pole pieces, in contrast, increases the length of the path along the edge of the gap, where the fringing flux passes.

Tapering the pole pieces decreases the permeance at the edge of the air gap and, as a result, decreases the fringing flux. However, this increases the magnetic potential at the pole piece edges, and much of the available flux is lost to intramagnet leakage, as illustrated in FIG. 3 at 306. In FIG. 3, a prior art H-shaped dipole permanent magnet structure 300 is comprised of a yoke 301 made of, for example, a permeable steel alloy, and two permanent magnets 302 and 303. To each of the permanent magnets is coupled a tapered pole piece 304 and 305, respectively, made of high permeability alloy. Air gap 308, through which flux lines 307 directly pass, completes the magnetic circuit. Because the pole pieces are made of high permeability alloy, and due to the reluctance of the air gap, the flux density along the beveled sides of the pole pieces increases. For example, the increase in flux density along a beveled side of pole piece 304 increases the magnetic potential across the magnet 302 and causes flux to leak back over the surface of magnet 302, as illustrated by flux lines 306. Thus, it can be seen that tapered pole pieces may not provide as much of an increase in gap flux density as desired due to intramagnet leakage.

With reference to FIG. 4, a prior art H-type dipole permanent magnet structure 400 improves upon the structure of FIG. 3 by placing blocking magnets (403, 404, 405 and 406) between pole pieces (407, 408, 409 and 410) and the yoke 401. In so doing, flux from the blocking magnets prevents leakage from the pole pieces back to the permanent magnets (402 and 403), or from the pole pieces to the yoke, thereby contributing to the total flux available (flux lines 412) at the gap 411. Leakage due to fringing flux is not entirely prevented due to the open areas to the side of air gap 411 into which the magnetic field in the air gap expands, reducing flux density in the air gap.

Although the flux density (B) of the external magnetic field in the air gap of the permanent magnet structure in FIGS. 3 and 4 is greater than the flux density in the air gap of the structures illustrated in FIGS. 2(*a*), (*b*), (*c*), and (*d*), B is still limited by the leakage of flux to some fraction of the intrinsic flux density of the magnet material used. The prior art permanent magnet structure of FIG. 5(*a*) further increases the flux density in an air gap through the superposition of the magnetic fields of each of the trapezoidal-shaped permanent magnet segments.

With reference to FIG. 5(*a*), a cross sectional view of a prior art dipole permanent magnet structure is illustrated. A plurality of trapezoidal shaped permanent magnet segments 502 are arranged about a longitudinal axis within a cylindrical yoke 501, forming a cylindrical air gap 503 along the center of the axis. The orientation of the magnetic field 504 of each segment 502 is positioned with respect to the orientation of the magnetic field of an adjacent segment to complete a magnetic circuit through the segments, thereby forming a uniform dipole magnetic field 505 in air gap 503 perpendicular to the longitudinal axis. FIG. 5(*b*) illustrates the effect of superpositioning the magnetic field 504 of each segment 502.

The permanent magnet structure 500 illustrated with reference to FIG. 5(*a*) forms a ring geometry with concentric inside and outside diameters in which the magnetization vector continuously rotates from pole to pole. In practice this geometry is approximated by an assembly of trapezoids 502 cut from generally rectangular or square blocks of magnet material. The blocks, before being cut, have a magnetic orientation straight through the block as induced during manufacturing or during the magnetization process for isotropic materials. With planning, the resulting trapezoids will have a magnetic orientation such that the magnetic vector components of each trapezoid will, by superposition, add to create the desired gap flux density 505 (FIG. 5(*b*)) in the round aperture or cylindrical air gap 503.

The prior art permanent magnet structure in FIG. 5(*a*) provides a very uniform magnetic field in the central two-thirds (⅔) of the interior diameter of air gap 503. However, a gap flux density greater than the residual flux density ($B_r$) of the magnet segments 502 may cause the inside corners of the segments to be exposed to a magnetic field whose intensity is greater than the intrinsic coercivity of the magnet material used in the segments. Such exposure can reverse the direction of magnetization in the corners of the segments, limiting the maximum flux density of the air gap. Furthermore, unlike the prior permanent magnet structures shown in FIGS. 3 and 4, ferrous material cannot be used in the permanent magnet structure of FIG. 5(*a*). Coupling permeable pole pieces to segments 502 in gap 503 would cause flux to be shunted through the pole pieces situated around the air gap rather than through the gap, lowering the flux density of the gap rather than increasing it. Thus, the maximum flux density of the air gap is proportional to the residual flux density of the magnet material used in the segments times the natural log of $R_o/R_i$, and factors for the number of segments used and the proximate length of the structure, where $R_o$ is the outside radius of the structure and $R_i$ is the inside radius of the structure.

Yet another limitation of the prior art permanent magnet structure shown in FIG. 5(*a*) is that the geometry is not well suited to applications requiring a rectangular aperture. When a square or rectangular gap is required for a given application involving a permanent magnet structure, the inner diameter of the structure of FIG. 5(*a*) must circumscribe the square or rectangular aperture. To generate a magnetic field in the air gap having a very high flux density of, e.g., 2 Tesla, the magnet structure of FIG. 5(*a*) needs approximately 35% more magnet material than a corresponding structure such as illustrated in FIGS. 6 and 7.

It is evident from the above discussion that an external magnetic field in a rectangular or square gap having a very high flux density or a flux density greater than the residual flux density ($B_r$) of the magnet material employed generally cannot be produced economically with the prior art dipole permanent magnet structures discussed thus far. The dipole permanent magnet structure illustrated in FIGS. 6 and 7, as described in U.S. Pat. No. 5,635,889, assigned to the assignee of the present invention, and incorporated herein by reference, can achieve high magnetic field intensities, for example, flux densities above 2 Tesla (20,000 Gauss).

The dipole permanent structure illustrated in FIGS. 6 and 7 is a dipole magnet structure capable of generating an external magnetic field in an air gap whose flux density is greater than the residual flux density of the magnet material employed in the dipole magnetic structure. According to the prior art permanent magnet structure illustrated in FIGS. 6 and 7, the flux density of the external magnetic field in the air gap is limited by the saturation flux density of the permeable material used in the pole pieces rather that the residual flux density of the magnet material used in the permanent magnets. However, the prior art permanent magnet illustrated in FIGS. 6 and 7 is limited in that the air gap is suitable only for certain applications requiring a rectangular or square aperture.

Additionally, the prior art dipole permanent magnet structure illustrated in FIGS. 6 and 7 is limited in that it can only provide a very limited range of flux densities in the rectangular gap. Some applications need a permanent magnet structure capable of providing a range of flux densities, from relatively low flux densities to very high flux densities. For example, in bolometers utilized in plasma diagnostics, or cryogenically cooled detector systems for detecting infrared and millimeter-wave frequencies, and other types of wide-band instrumentation, it is beneficial to offer superior sensitivity, in terms of the operating frequency range. The frequency range is set, in part, by positioning a detector crystal in a specific magnetic field density ranging from 0.5 to 2.0 Tesla. In the prior art, dipole permanent magnet structures provide a very limited range of flux densities. Thus, a different dipole permanent magnet structure must be utilized for each desired frequency. What is needed is a single dipole permanent magnet structure capable of providing a magnetic field in a gap having a range of magnetic flux densities.

BRIEF SUMMARY OF THE INVENTION

The present invention relates to a configuration of a plurality of permanent magnets for producing a permanent magnet (PM) structure capable of generating a substantially linearly varying flux density magnetic field in an aperture or gap formed by the permanent magnets, while minimizing the required volume of magnet material.

An embodiment of the present invention provides a dipole permanent magnet structure that employs superpositioning of the magnetic fields of each of the permanent magnets therein to create a magnetic field in an air gap that has a varying flux density ranging from a relatively low flux density (e.g., 0.5 Tesla or even lower) to a flux density greater than the residual flux density of the magnet material employed in the permanent magnets (e.g., 2.0 Tesla or even higher). The configuration of the permanent magnets drive tapered pole pieces progressively into saturation. Blocking magnets are sized and shaped so they contribute flux lines to the superimposed magnetic field and form a blocking field to prevent fringing flux around the gap. The structure provides a magnetic field with the highest possible gap flux density for a given amount of highly coercive permanent magnet material. The permanent magnets may be comprised of rare earth magnet material such as Samarium Cobalt or Neodymium Iron Boron. Pole pieces may be comprised of permeable material such as low carbon steel, cold rolled steel, or Hiperco 50, depending on the range of gap flux densities desired. Additionally, the gap is shaped such that a substantially linear range of magnetic field intensities are produced, such that an object can be placed at different positions along the longitudinal axis of the gap, depending on the magnetic flux density desired

BRIEF DESCRIPTION OF THE SEVERAL VIEWS OF THE DRAWINGS

The embodiments of the present invention are illustrated by way of example and not limitation the accompanying figures, in which:

FIG. 2(*b*1–3) illustrates another prior art method for minimizing the effects of fringing flux and leakage flux in permanent magnet structures.

FIG. 2(*c*1–2) illustrates a further prior art method for minimizing the effects of fringing flux and leakage flux in permanent magnet structures.

FIG. (*d*1–2) illustrates yet another prior art method for minimizing the effects of fringing flux and leakage flux in permanent magnet structures.

Figure 1:
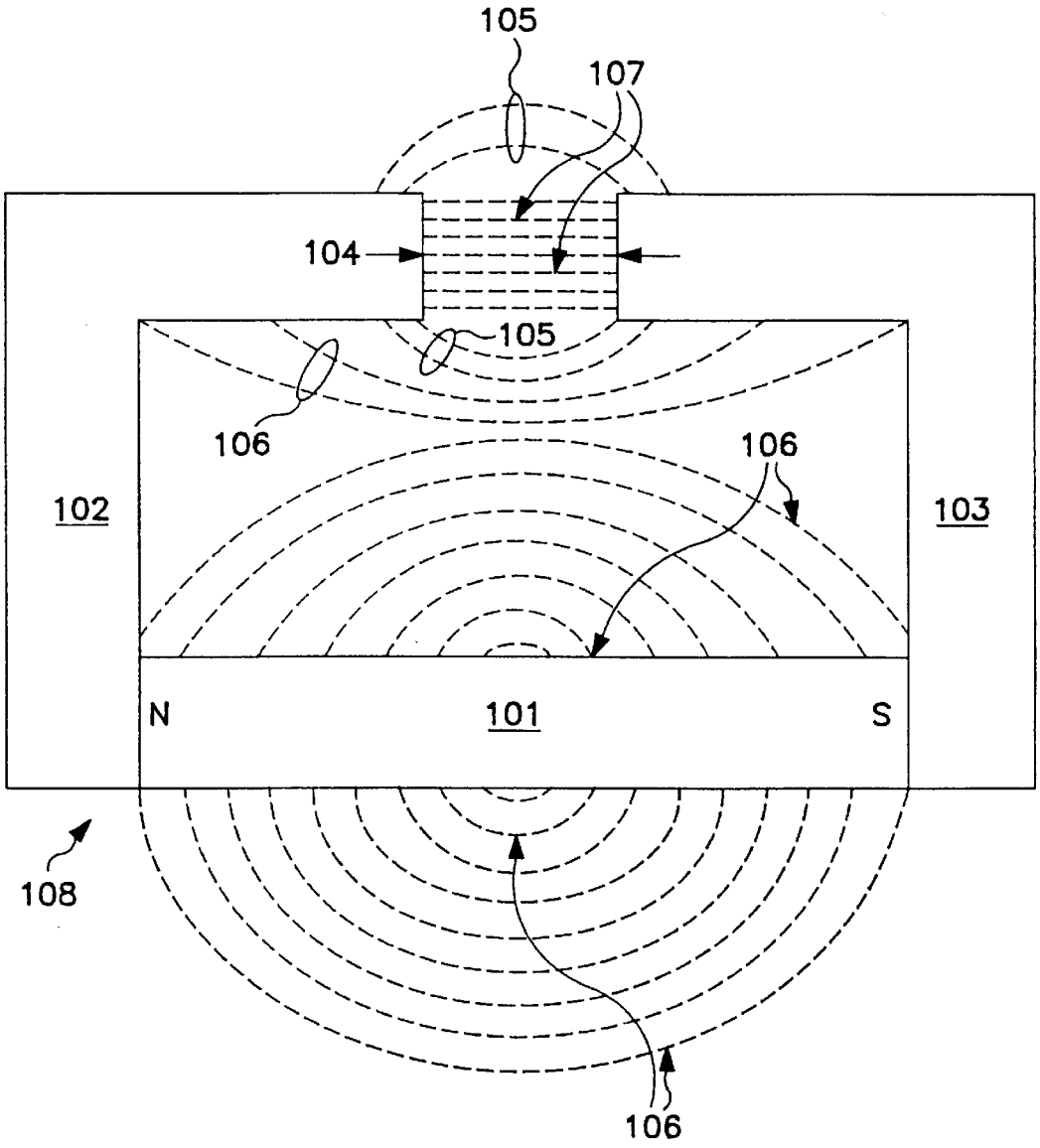
FIG. 1 (PRIOR ART)
FIG. 1 is a diagram of a prior art dipole permanent magnet structure illustrating leakage and fringing flux.
Figures 1, 2A:
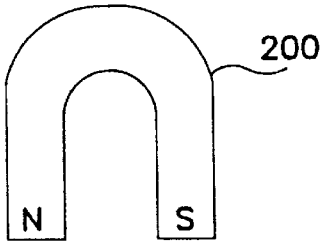
FIG. 2A-1 (PRIOR ART)
Figures 2, 2A:
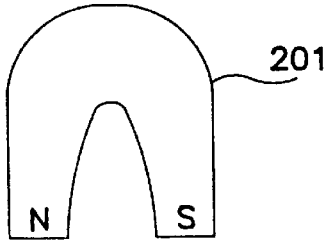
FIG. 2A-2 (PRIOR ART)
FIG. 2(*a*1–2) illustrates a prior art method for minimizing the effects of fringing flux and leak,[]e flux in permanent magnet structures.
Figures 1, 2B:
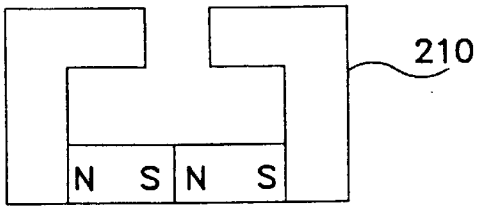
FIG. 2B-1 (PRIOR ART)
Figures 2, 2B:
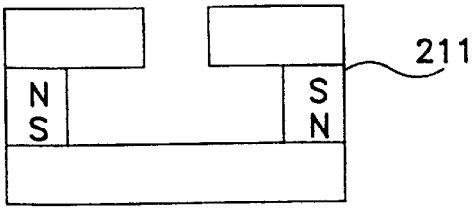
FIG. 2B-2 (PRIOR ART)
Figures 2, 2B, 3:
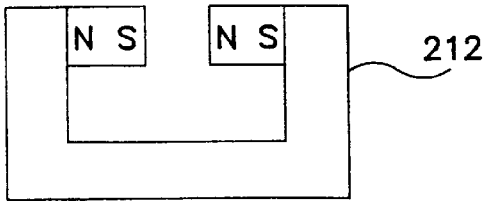
FIG. 2B-3 (PRIOR ART)
Figures 1, 2C:
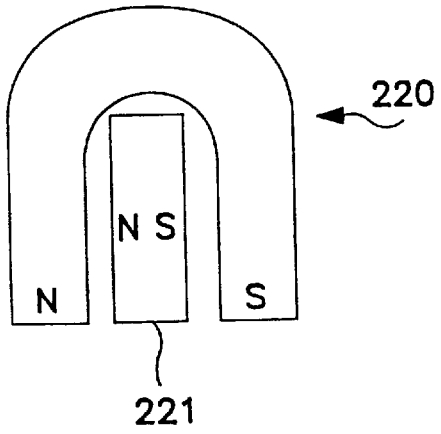
FIG. 2C-1 (PRIOR ART)
Figures 2, 2C:
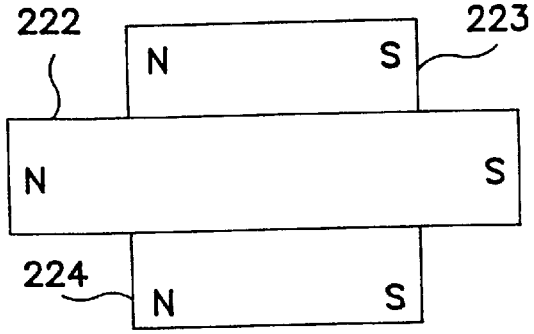
FIG. 2C-2 (PRIOR ART)
Figures 1, 2D:
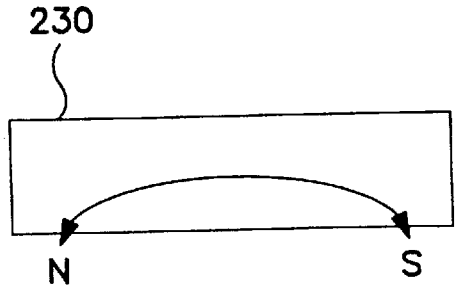
FIG. 2D-1 (PRIOR ART)
Figures 2, 2D:
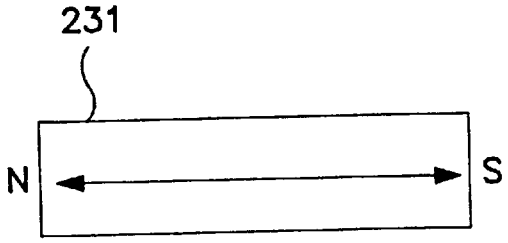
FIG. 2D-2 (PRIOR ART)
Figure 3:
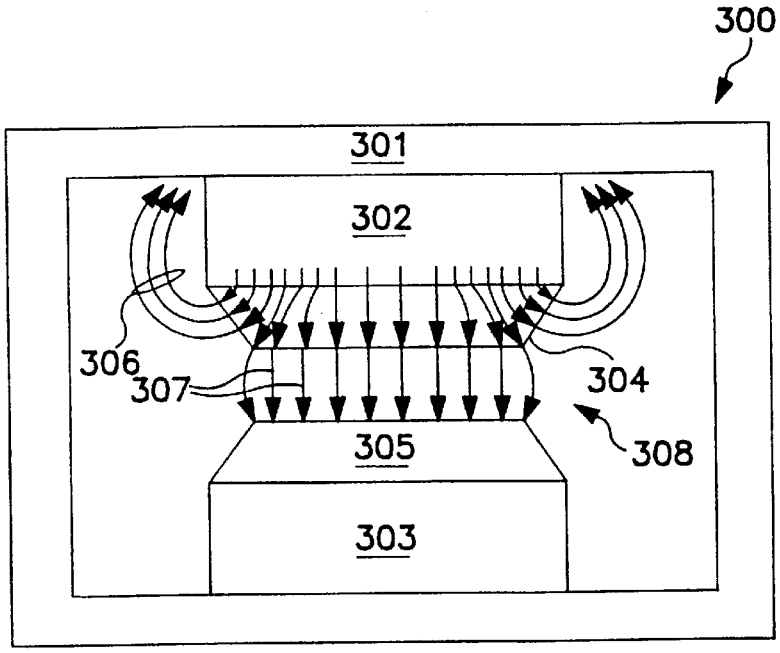
FIG. 3 (PRIOR ART)

FIG. 3 is an illustration of an prior art H-shaped dipole permanent magnet structure.

Figure 4:
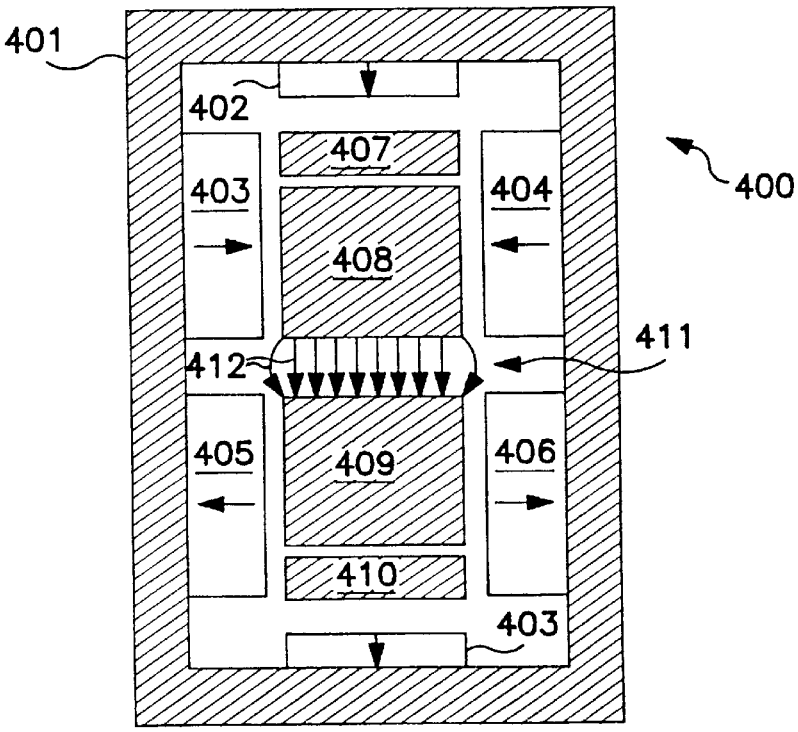
FIG. 4 (PRIOR ART)

FIG. 4 is an illustration of a prior art H-shaped dipole permanent magnet structure.

Figure 5A:
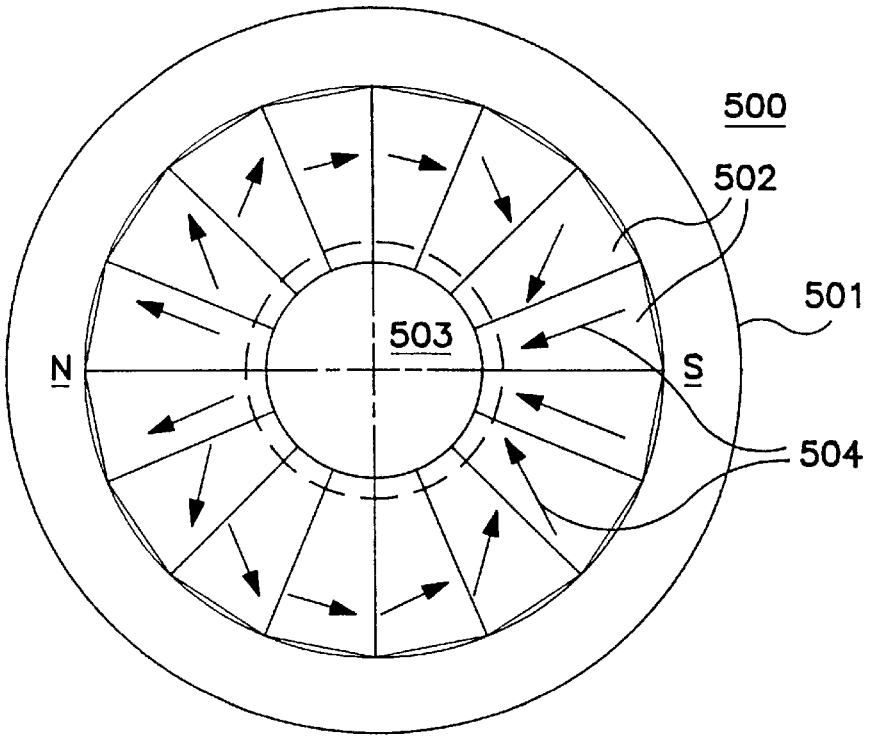
FIG. 5A (PRIOR ART)
Figure 5B:
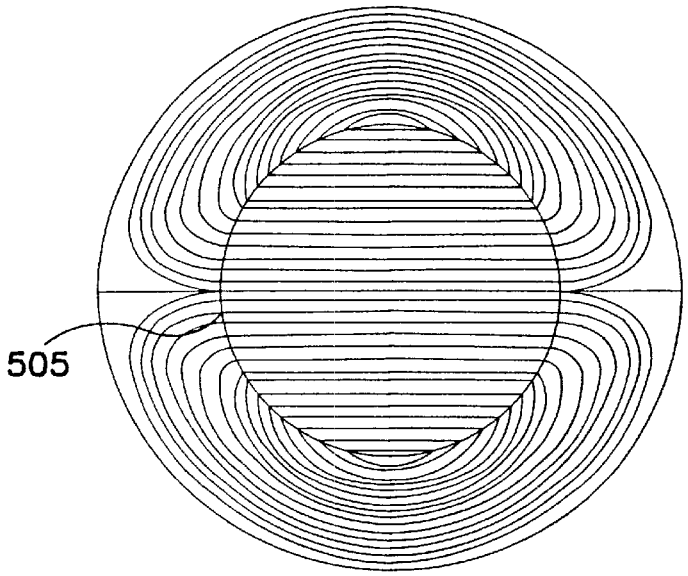
FIG. 5B (PRIOR ART)

FIG. 5(*a*) is a cross sectional view of yet another prior art dipole permanent magnet structure.

FIG. 5(*b*) illustrates the orientation of the magnetic lines of force of the permanent magnet structure in FIG. 5(*a*).

Figure 6:
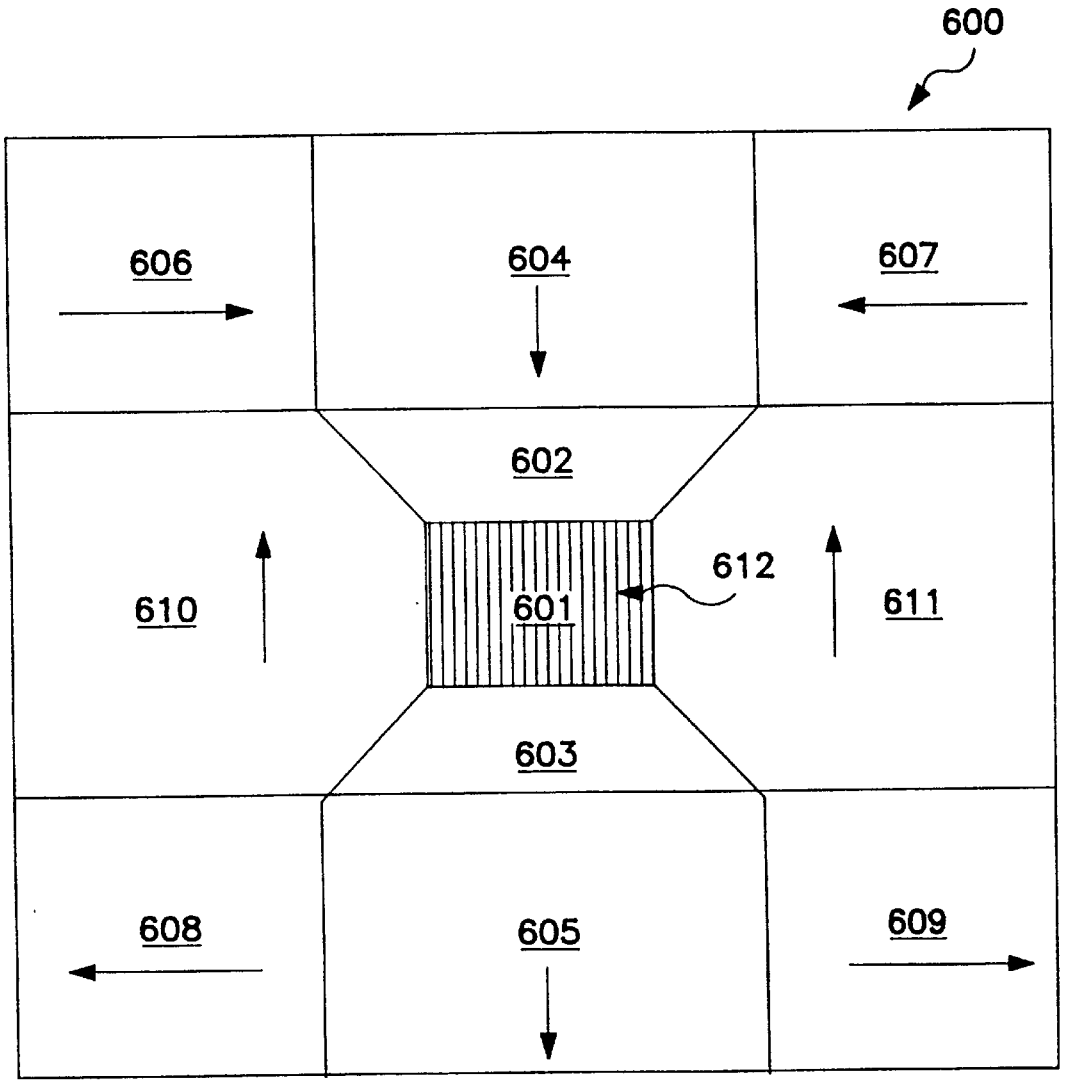
FIG. 6 (PRIOR ART)

FIG. 6 is a cross sectional, two dimensional view of prior art permanent magnet structure.

Figure 7:
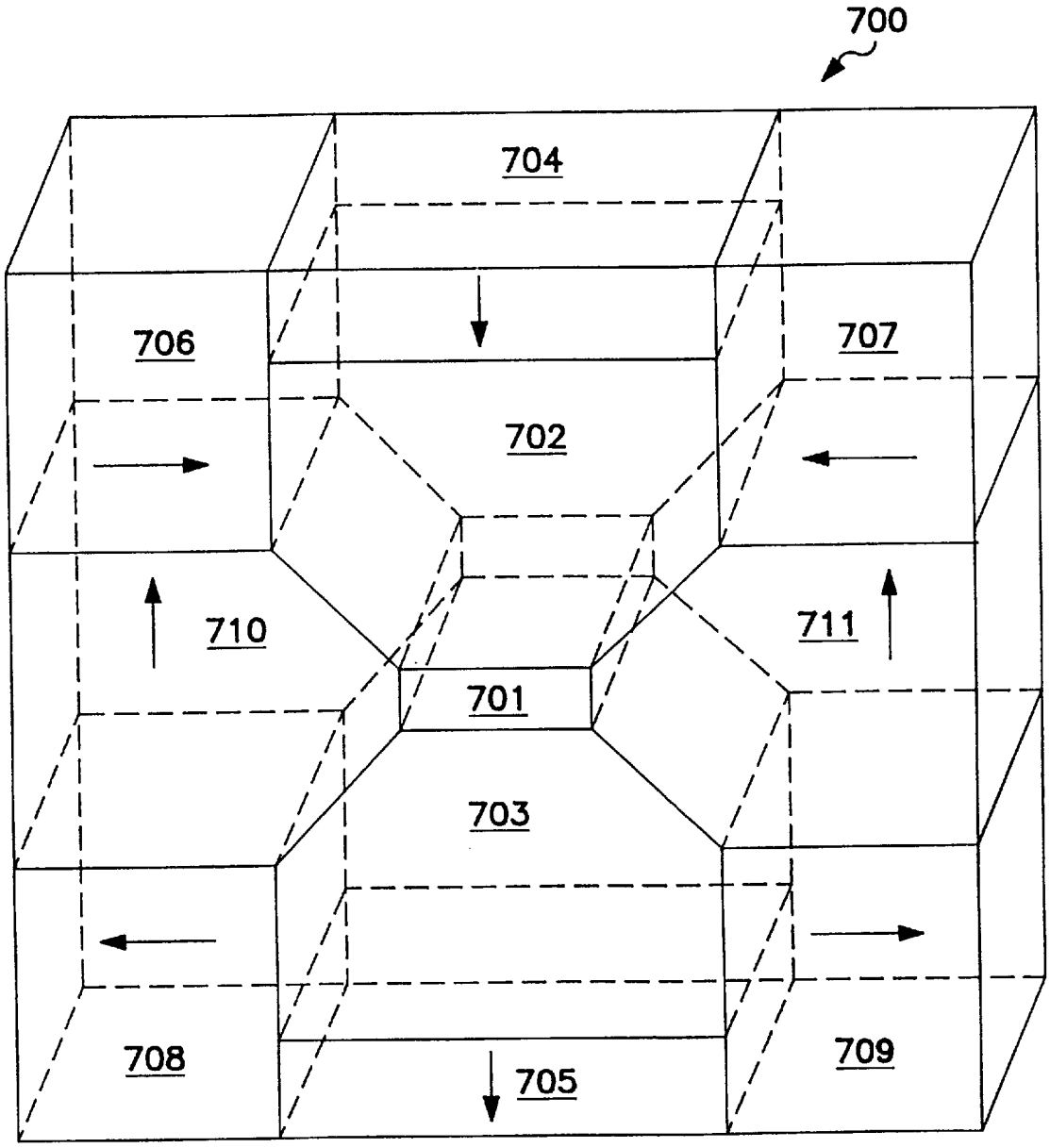
FIG. 7 (PRIOR ART)
Figure 8A:
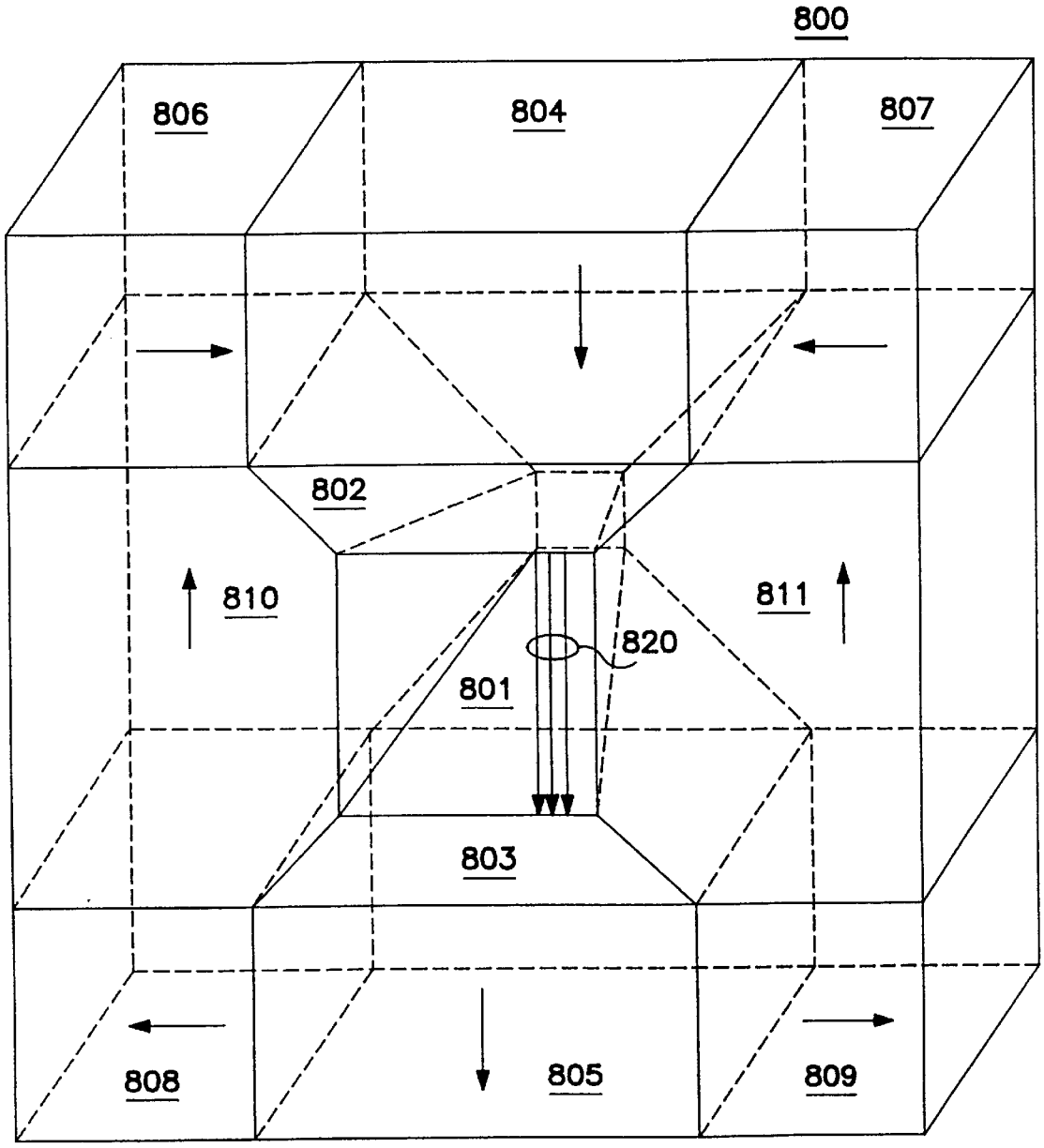
Figure 8B:
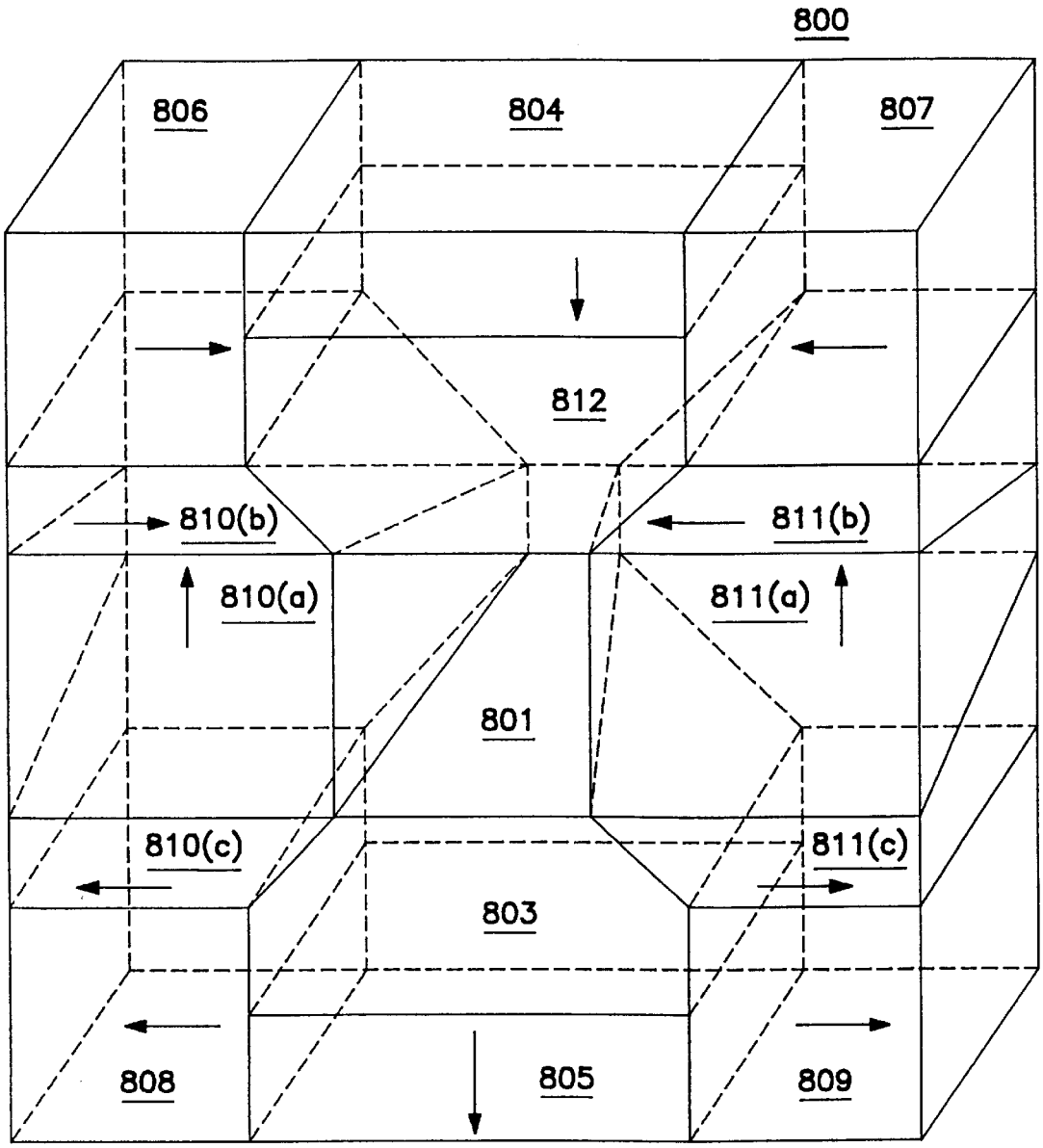
Figure 8C:
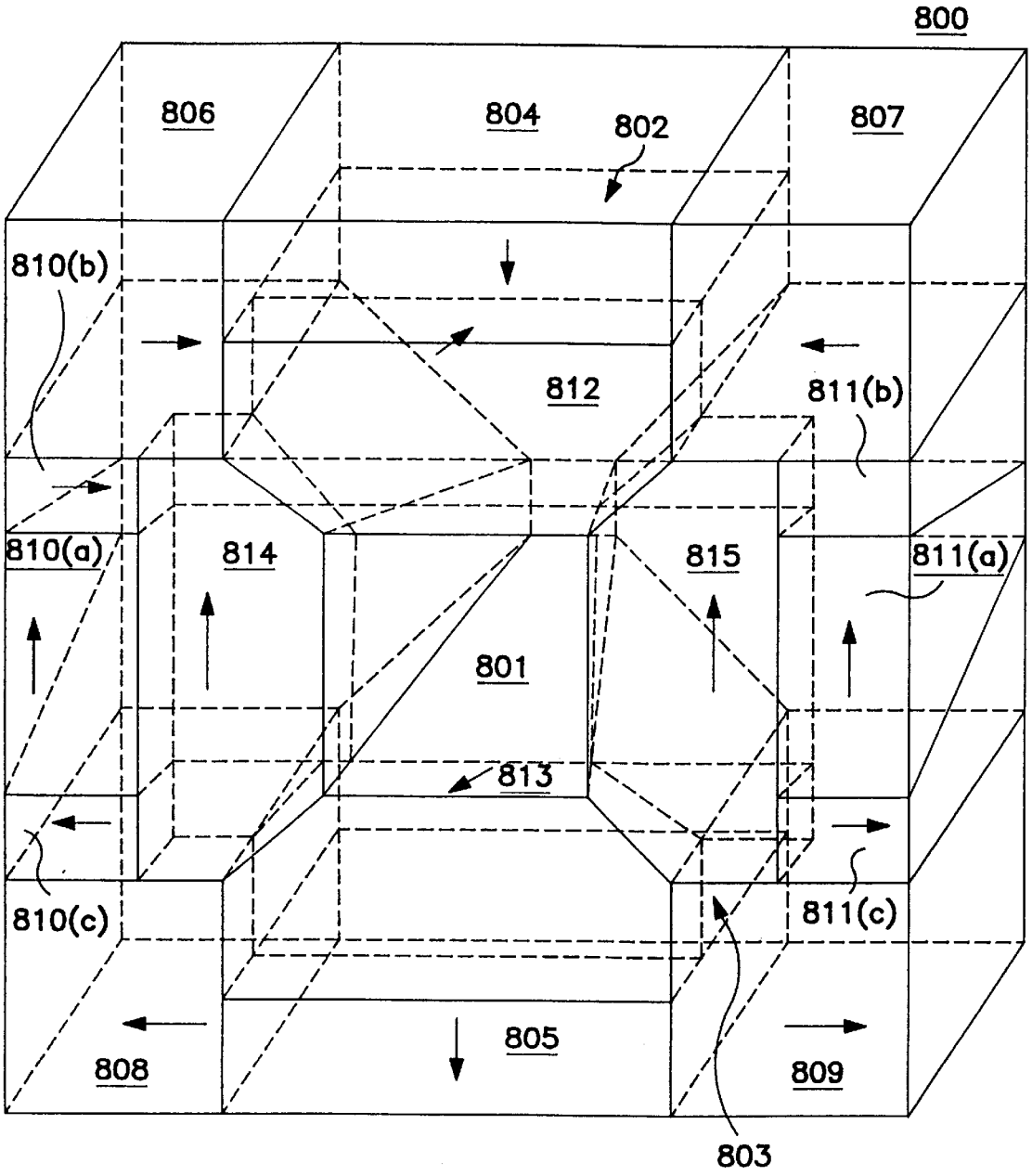
Figure 8D:
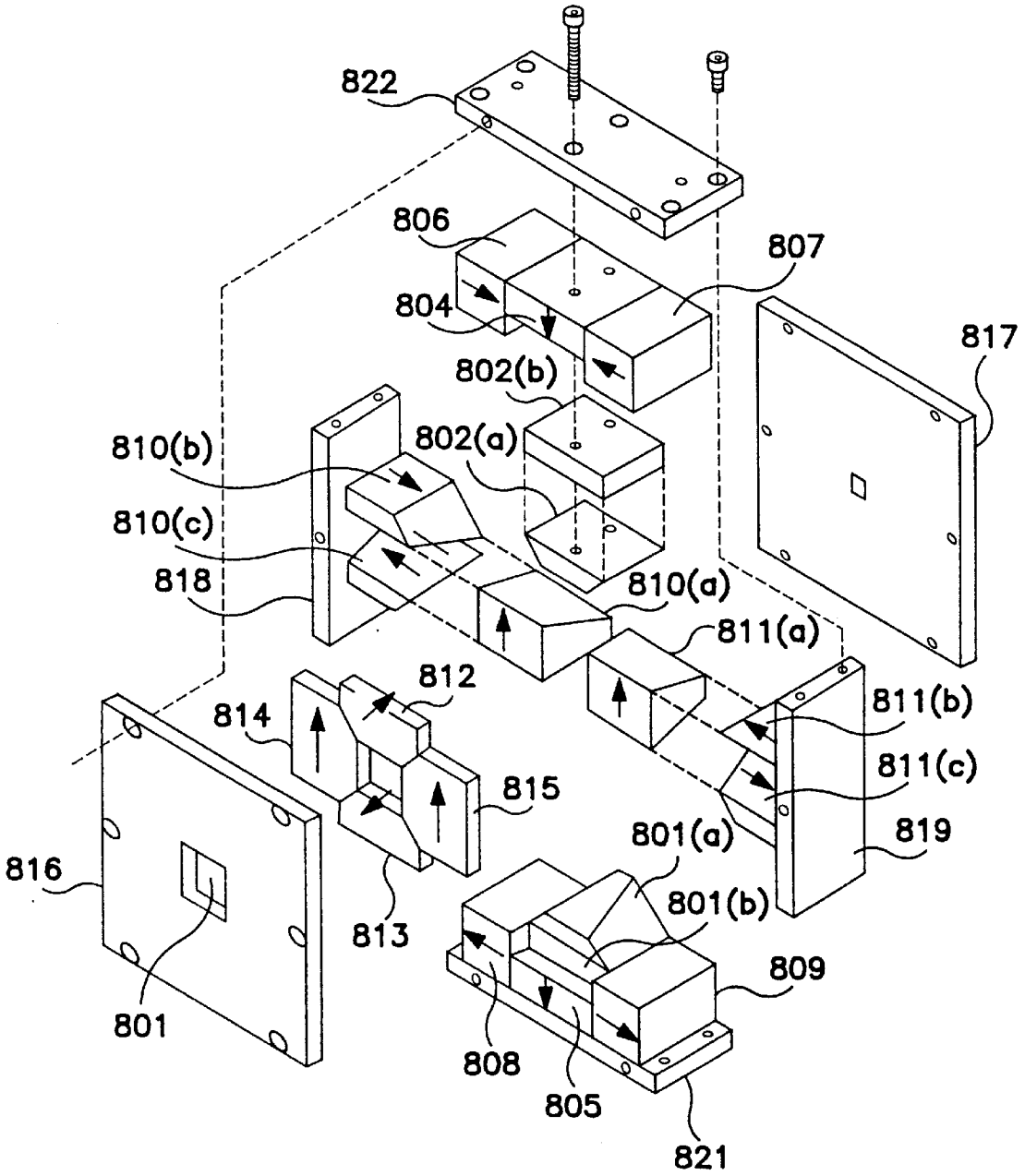

FIG. 7 is a cross sectional, three dimensional view of the prior art permanent magnet structure illustrated in FIG. 6.

FIG. 8(*a*) is a three dimensional view of an embodiment of the present invention.

FIG. 8(*b*) is a three dimensional view of another embodiment of the present invention.

FIG. 8(*c*) is a three dimensional view of another embodiment of the present invention.

FIG. 8(*d*) is an exploded three dimensional view of another embodiment of the present invention.

DETAILED DESCRIPTION OF THE INVENTION

In the following description, numerous specific details are set forth in order that a thorough understanding of the present invention is provided. It will be apparent, however, to one of ordinary skill in the art that the present invention may be practiced without these specific details. In other instances, well-known structures, materials, and techniques have not been shown in order not to unnecessarily obscure the present invention.

The present invention relates to a configuration of a plurality of permanent magnets for producing a dipole permanent magnet (PM) structure capable of generating an external magnetic field in an aperture or gap formed by the permanent magnets while minimizing the total volume of magnet material in the structure. The permanent magnet structure is capable of generating a magnetic field having a range of flux densities, from a relatively low flux density to a very high flux density in the gap (e.g., 0.5 to 2.0 Tesla/5000 to 20,000 Gauss).

The structure provides for a gap having a magnetic field wherein the range of flux densities in the field form a substantially linear gradient along the longitudinal axis of the gap. In one embodiment of the present invention, a dipole PM structure combines principles of 1) superpositioning of the magnetic fields of adjacent permanent magnets to complete through the varying alignment of the magnetic fields a magnetic circuit through the PM structure with 2) the use of tapered permeable pole pieces made of, for example, 2V-Permendur or Hiperco 50 to produce a very high flux density in an aperture, or air gap, formed by the configuration of the individual permanent magnets and pole pieces, and 3) a rectangular gap tapered along its longitudinal axis in recognition of the principle that the permeance of the air gap is directly proportional to the area of the gap and inversely proportional to the length between poles across the gap, to. provide a linear gradient magnetic field intensity.

Superpositioning the magnetic fields of permanent magnets requires the use of magnet materials with an intrinsic coercivity in excess of the flux density established at the juncture of magnets, and magnets and pole pieces, to minimize the tendency to demagnetize abutting magnets. This is especially important in the magnet segments bounding the sides of the gap aperture, where the flux direction is opposite to that of the gap, since the gap flux density may be in excess of 1.5 times the magnet material's residual magnetization. The demagnetizing forces at exterior joints between magnets is diminished by surrounding the magnet assembly with a magnetically permeable material, such as steel, which provides a low reluctance flux path around the joint. This permits using materials with the highest available residual flux density (Br) in most portions of the magnetic circuit, so long as intrinsic coercivity is adequate for the particular circuit element. Indeed, the maximum flux density in the air gap of an embodiment of the present invention is to some extent limited by the saturation flux density of the pole pieces—approximately 2.4 Tesla (24,000 Gauss), well above those prior art dipole permanent magnet structures that are limited by the residual flux density of the permanent magnet material—approximately 1.4 Tesla (14,000 Gauss). Thus, an embodiment of the present invention is able to produce an external magnetic field in an air gap of a permanent magnet structure in which the maximum flux density in the air gap is 1 Tesla (10,000 Gauss) greater than the maximum flux density in the air gap of traditional dipole permanent magnet structures.

The maximum flux density capable of being produced in the air gap of a prior art dipole permanent magnet structure such as that found in FIG. 5(*a*) is limited by the intrinsic coercivity of the permanent magnet material used. Although magnet materials exist that have an intrinsic coercivity ($H_{ci}$) of approximately 2.4 million Ampere-turns/meter (30,000 Oersteds), it is at a substantial reduction in residual flux density. As a result, a magnet structure capable of achieving an external magnetic field having a flux density of 2.2 Tesla (22,000 Gauss) in the prior art structure of FIG. 5(*a*) would have to employ a large volume of lower flux density material to minimize joint demagnetization and overcome leakage of flux at the proximate and distal ends of the structure.

As will be demonstrated with reference to FIGS. 8(*a*)–8(*d*), the ability of an embodiment of the present invention to produce an external magnetic field having a linearly varying flux density is related to the varying alignment of the magnetic field orientations of the permanent magnets comprising the dipole permanent magnet structure to achieve a complete magnetic circuit through the magnet material and the air gap, in combination with the varying area in and distance between poles across the gap along its longitudinal axis. The orientation of the magnetic field of each permanent magnet in the structure is positioned to generally align each permanent magnet's orientation in the same direction as the magnetic lines of force, i.e., the flux lines, for the magnetic circuit formed by the structure. A rectangular air gap tapers from a proximate end along a longitudinal axis to a distal end such that the distance between the poles forming opposing sides of the rectangular gap and the area in the gap vary along the longitudinal axis to produce a magnetic field with a flux density that increases according to a linear gradient as the gap narrows in the direction of the distal end.

In another embodiment of the present invention, pole pieces (which may or may not be tapered in the direction of the air gap) are used on opposing sides of the rectangular air gap. Moreover, the pole pieces are in contact with the permanent magnets on all surfaces other than the pole tip.

As will be seen, each permanent magnet in an embodiment of the present invention is shaped and positioned adjacent to one another in such a way as to have a positive adding superposition effect on magnetic lines of force flowing from the north pole to the south pole of the dipole structure. If a surface of a permanent magnet is not in contact with the surface of an adjacent permanent magnet, then leakage flux will result, causing a reduction of the magnetic field intensity in the air gap of the structure similar to but on a larger scale than the reduction that occurs as a result of glue placed between the surfaces of the permanent magnets during the assembly process.

The essential elements as discussed above are primarily responsible for producing an external magnetic field in the air gap in which the maximum flux density of the field is limited only by the saturation flux density of the pole pieces in an embodiment of the present invention. Thus, the present invention is capable of using modern high energy product magnet materials efficiently. As a direct result, much less magnet volume is required to achieve a maximum flux density in the square or rectangular air gap of approximately 2.2 to 2.4 Tesla (22.000 to 24,000 Gauss) than a prior art dipole permanent magnet structure such as that illustrated in FIG. 5(*a*).

With reference to FIG. 8(*a*), an embodiment of the present invention is described. FIG. 8(*a*) provides a three-dimensional view of a dipole permanent magnet structure as may be embodied by the present invention. An air gap 801, substantially centered about a longitudinal axis and rectangular in shape, provides an area in which work may be performed upon an object placed in or passed through the aperture along the longitudinal axis. In another embodiment, all sides of air gap 801 may be equilateral, forming a square. In the illustrated embodiment, the aperture narrows from a proximate end to a distal end, such that the magnetic flux density increases, based on the principle that the permeance of an air gap is directly proportional to the area of the gap and inversely proportional to the length of the gap between the pole pieces.

Air gap 801 is bounded on opposing sides by permeable pole pieces 802 and 803 comprised of, for example, low carbon steel, 2V-Permendur, or Hiperco 50. Whatever the composition of the permeable material, the material has a saturation flux density greater than that of the magnet material comprising the permanent magnets. The pole pieces are tapered on two sides toward the gap, so that the pole pieces are wider at their base (the surface furthest from the gap) than at their tip (the surface facing the gap). Through pole pieces 802 and 803 passes a magnetic field whose flux lines 820 are in a direction substantially perpendicular to the longitudinal axis. Additionally, in the illustrated embodiment, the pole pieces are tapered along the longitudinal axis, from the distal end to the proximate end of the aperture, thus narrowing the distance between the pole pieces, and increasing the flux density, in the direction of the distal end of the rectangular gap.

Coupled to the base of each pole piece 802 and 803 is a permanent magnet (PM) 804 and 805, respectively. Permanent magnets 804 and 805, as well as all other permanent magnets in an embodiment of the present invention, are comprised of rare earth magnet material, for example, Samarium Cobalt or Neodymium Iron Boron. Such rare earth magnet materials have a very large intrinsic moment per unit volume, i.e., a high saturation magnetization. Moreover, they exhibit an extremely high resistance to demagnetization by an external field, i.e., they exhibit high coercivity. Thus, the magnet material has a linear magnetization curve (B/H ratio) in the second quadrant of the hysteresis loop, indicating the material has a very high residual flux density and is able to maintain this flux density in the presence of very high demagnetizing fields, even those in excess of the remanence of the material. Permanent magnets 804 and 805 are rectangular in shape and (as indicated by the arrows thereon in FIG. 8(*a*) have magnetic fields oriented in the same direction as the magnetic field between the pole pieces.

Permanent magnets 806 and 807 are coupled adjacent to opposing surfaces of permanent magnet (PM) 804. Both magnets are also rectangular in shape and have magnetic lines of force oriented toward PM 804, at substantially right angles to the magnetic field orientation of PM 804, thereby superpositioning their magnetic fields on the magnetic field of PM 804. Likewise, permanent magnets 808 and 809 are coupled adjacent to opposing surfaces of PM 805. Both are rectangular in shape and have their magnetic fields oriented away from and at a right angle to the magnetic field of PM 805, thereby superpositioning their magnetic fields on the magnetic field of PM 805.

Permanent magnets 810 and 811 are polygon in shape. More specifically, in one embodiment of the present invention, they each form a tapered hexagonal shape perpendicular to the longitudinal axis. PM 810 is coupled between PMs 806 and 808, while PM 811 is coupled between 807 and 809. PMs 810 and 811 are sized and shaped so their fields are superpositioned with the magnetic fields of adjacent permanent magnets 806, 808, 807 and 809. Thus, the magnetic field of PM 810 is oriented toward PM 806 and is at right angles to the magnetic fields of PM 806 and 808. Likewise, the magnetic field of PM 811 is oriented toward PM 807 and is at right angles to the magnetic fields of PM 807 and 809. By aligning the magnetic fields of each of the permanent magnets 806-811 in this manner, each PM contributes to the orientation and intensity of the magnetic field passing through pole piece 802 to pole piece 803 by adding to and completing a dipole magnetic circuit through the permanent magnet structure 800.

Additionally, PMs 810 and 811 act as blocking magnets. A surface on each of PMs 810 and 811 combine to form opposing sides of air gap 801, completing the rectangular aperture formed with the adjacent surfaces of the pole piece tips. These surfaces on PMs 810 and 811 abutting the aperture, in addition to the orientation of the magnetic fields of PMs 810 and 811 make the PMs operate as blocking magnets to force fringing flux back into the gap at the sides of the rectangular gap adjacent the pole piece tips. Moreover, PMs 810 and 811 force lines of flux at the tapered sides of pole pieces 802 and 803 to focus through the gap rather than around the gap. Further, in the illustrated embodiment, the blocking magnets are tapered along the longitudinal axis, from the distal end to the proximate end of the aperture, thus narrowing the distance between the blocking magnets, and increasing the flux density, in the direction of the distal end of the rectangular gap, in concert with the pole pieces which are likewise tapered in the same manner, as described above.

FIG. 8(*b*) illustrates, for example, another embodiment of the present invention. The embodiment described with reference to FIG. 8(*b*) operates in essentially the same manner as the embodiment described with reference to FIG. 8(*a*). FIG. 8(*b*) provides a three-dimensional view of an embodiment of the present invention in which pole pieces 802 and 803, unlike the pole pieces in FIG. 8(*a*), extend into the permanent magnet material such that the size of permanent magnets 804 and 805 is smaller with respect to the other permanent magnets 806–811 in the embodiment, i.e., the pole pieces are relatively larger. More importantly, the pole pieces have five surfaces adjacent permanent magnets as opposed to three surfaces in the previously discussed embodiment. For example, pole piece 802 has surfaces adjacent, or coupled to, a surface of permanent magnets 804, 806 and 807, 810 and 811. The tapered pole pieces extend into the magnet material to allow them to be driven by the magnet material on each surface in contact with the permanent magnets so that flux is collected in the pole pieces and focused on the air gap from all surfaces of the pole pieces (other than the axial end surfaces). This has a significant impact on reducing leakage flux, as the permanent magnets are collectively pushing and concentrating the lines of flux back toward the pole pieces and the air gap to achieve a high flux density in the air gap.

FIG. 8(*b*) further illustrates blocking magnets 810 and 811 comprising magnets 810(*a*), 810(*b*) and 810(*c*), and 811(*a*), 811(*b*) and 811(*c*), respectively. The magnets are separated for ease of manufacture. Also note that the orientation of the magnetic fields in, e.g., magnets 810(*b*) and 810(*c*) are aligned with those of the adjacent permanent magnets, to facilitate the dipole magnetic circuit through the permanent magnet structure 800. Likewise, the magnetic field orientations of permanent magnets 811(*b*) and 811(*c*) are aligned with respect to the magnetic field orientations of their respectively adjacent permanent magnets 806 and 808.

FIG. 8(*c*) illustrates yet another embodiment of the present invention. As with FIG. 8(*b*), FIG. 8(*c*) operates in essentially the same manner as the embodiment described with reference to FIG. 8(*a*). The permanent magnet structure 800 of FIG. 8(*c*) further reduces leakage flux by capping the axial ends of the pole pieces with permanent magnets (which may be referred to as capping magnets because the magnets "cap" the pole pieces) oriented so that their fields add by superposition to the flux density in the gap while blocking leakage flux out the axial ends of the pole pieces. Thus, pole piece 802 is capped on the proximate axial end by capping magnet 812. Likewise, pole piece 803 is capped on the proximate axial end by capping magnet 813. Although not shown, the distal axial ends of pole pieces 802 and 803 may likewise be capped. It is appreciated that the dimensions of the capping magnets depend on the dimensions of the axial ends of the pole pieces. Thus, although in the embodiment in FIG. 8(*c*) the axial ends of the pole pieces are polygon in shape, the capping magnets may well be a polygon of a different shape and dimension, such as a rectangle or square.

The permanent magnet structure 800 of FIG. 8(*c*) further reduces leakage flux by capping at least a portion of the axial ends of the blocking magnets with capping magnets oriented so that their magnetic fields add by superposition to the flux density in the gap while blocking leakage flux out the axial ends of the blocking magnets. Thus, blocking magnet 810 (comprised of components 810*a–c*) is partially capped on the proximate axial end by capping magnet 814. Likewise, blocking magnet 811 (comprised of components 811*a–c*) is partially capped on the proximate axial end by capping magnet 815. Although not shown, at least a portion of the distal axial ends of the blocking magnets 810 and 811 may likewise be capped. It is appreciated that the dimensions of the capping magnets depend on the dimensions of the axial ends of the blocking magnets, and the extent to which the blocking magnets are capped, e.g., either partially or wholly, by the capping magnets. Thus, although in the embodiment in FIG. 8(*c*) the axial ends of the blocking magnets are polygon in shape, the capping magnets may well be a polygon of a different shape and dimension, such as a rectangle or square.

Some flux leakage occurs where magnets with quadrature magnetic field orientations are joined, i.e., where the magnetic fields of adjacent permanent magnets are oriented at right angles to one another, as illustrated in, for example, FIG. 8(*d*). By enclosing the outside dimension of the permanent magnet structure 800 with a shell of permeable material, for example, steel, leakage flux is further reduced, thereby increasing the flux density in the rectangular or square air gap 801. With reference to FIG. 8(*d*), the permeable shell is comprised of plates 818, 819, 821 and 822 of permeable material, each of which are affixed to the four outside surfaces of permanent magnet structure 800.

The permeable shell is useful as well in assembling the permanent magnets comprising structure 800 in that bringing the permanent magnets together while in contact with the shell causes some of the magnetic flux from the permanent magnets to be shunted by the permeable shell. The force of attraction to the shell material reduces the forces of repulsion between the permanent magnets where permanent magnets of like polarities are adjacent to each other.

In a preferred embodiment, the shell is bolted to the permanent magnet structure, in addition to gluing the permanent magnets together with an epoxy, to withstand the extreme temperature conditions to which the structure is exposed, e.g., when submersed in liquid helium or nitrogen, as when embodied in a cryogenically cooled detector system, and the different thermal characteristics/coefficients of expansion of the components comprising the structure 800. Alternatively, the permanent magnets and pole pieces may be coupled via complex dovetails (not shown) produced by wire electro discharge machining (EDM).

There are, of course, many possible alternatives to the described embodiments that are within the understanding of one of ordinary skill in the relevant art. The present invention is limited, therefore, only by the claims presented below. Thus, what has been described is a dipole permanent magnet structure for generating an intense external magnetic field in the tapered rectangular gap of the permanent magnet structure, wherein the flux density of the magnetic field increases according to a linear gradient along the longitudinal in axis of the tapered rectangular gap.

What is claimed is:

1. A dipole permanent magnet structure for providing a magnetic field, the structure comprising:

a rectangular gap substantially centered about a longitudinal axis, the rectangular gap having an proximate end and a distal end, the rectangular gap tapered from the proximate end to the distal end to provide an increasing magnetic flux density in the magnetic field present in the rectangular gap when moving from the proximate end to the distal end of the rectangular gap, such that the rectangular gap is relatively smaller at the distal end than at the proximate end;

a pair of permeable pole pieces situated to form two opposing sides of the rectangular gap; and at least eight permanent magnets coupled about the longitudinal axis, wherein two of the permanent magnets each form a side of the rectangular gap normal to the two opposing sides of the rectangular gap formed by the pole pieces, the at least eight permanent magnets each having a magnetic field orientation aligned to form a magnetic circuit that generates the magnetic field in the rectangular gap.

2. The dipole permanent magnet structure of claim 1, wherein the magnetic flux density in the magnetic field increases according to a substantially linear gradient when moving from the proximate end to the distal end of the rectangular gap.

3. The dipole permanent magnet structure of claim 1, wherein the magnetic flux density of the magnetic field at the distal end of the rectangular gap is greater than the residual flux density of the magnetic field of each of the at least eight permanent magnets.

4. The dipole permanent magnet structure of claim 1, wherein the pair of permeable pole pieces taper along the longitudinal axis from the distal end to the proximate end of the rectangular gap.

5. The dipole permanent magnet structure of claim 1, wherein the two permanent magnets that each form a side of the rectangular gap normal to the two opposing sides of the rectangular gap formed by the pole pieces taper along the longitudinal axis from the distal end to the proximate end of the rectangular gap.

6. The dipole permanent magnet structure of claim 1, wherein the rectangular gap has equilateral sides.

7. The dipole permanent magnet structure of claim 1, wherein each of the at least eight permanent magnets is a rectangular block of magnet material.

8. The dipole permanent magnet structure of claim 1, wherein each of the at least eight permanent magnets is made of a highly coercive magnet material.

9. The dipole permanent magnet structure of claim 1, wherein each of the at least eight permanent magnets is comprised of a rare earth permanent magnet material.

10. The dipole permanent magnet structure of claim 9, wherein the rare earth permanent magnet material is Samarium Cobalt.

11. The dipole permanent magnet structure of claim 9, wherein the rare earth permanent magnet material is Neodymium Iron Boron.

12. The dipole permanent magnet structure of claim 1, further comprising a permeable shell coupled to the at least eight permanent magnets to reduce leakage flux.

13. The dipole permanent magnet structure of claim 1, further comprising a pair of capping magnets each capping the proximate end of one of the pair of permeable pole pieces, the capping magnets having a magnetic field oriented to add by superposition to the magnetic flux density in the rectangular gap and block leakage flux out of the proximate end of the permeable pole pieces.

14. The dipole permanent magnet structure of claim 13, further comprising a second pair of capping magnets each capping the distal end of one of the permeable pole pieces, the capping magnets having a magnetic field oriented to add by superposition to the magnetic flux density in the rectangular gap and block leakage flux out of the distal end of the permeable pole pieces.

15. A dipole permanent magnet structure having a rectangular gap substantially centered about a longitudinal axis, the rectangular gap having an proximate end and a distal end, the dipole permanent magnet structure comprising:

a first pole piece and a second pole piece forming opposing sides of the rectangular gap to permit a magnetic field having a magnetic flux density in the rectangular gap;

a first permanent magnet coupled to the first pole piece, having a magnetic field oriented toward the first pole piece;

a second permanent magnet coupled to the second pole piece, having a magnetic field oriented away from the second pole piece, the first and second permanent magnets generating a magnetic field in the rectangular gap, the first and second pole pieces and the first and second permanent magnets tapered along the longitudinal axis from the distal end to the proximate end of the rectangular gap causing the rectangular gap to taper from the proximate end to the distal end, increasing the magnetic flux density in the direction of the distal end of the rectangular gap; and a plurality of permanent magnets coupling the first and second permanent magnets to form a magnetic circuit through the rectangular gap, the plurality of permanent magnets each having a magnetic field oriented to intensify the magnetic field in the rectangular gap, the magnetic field in the first and second permanent magnets and each of the plurality of permanent magnets having a residual magnetic flux density, wherein the magnetic flux density at the distal end of the rectangular gap is greater than the residual magnetic flux density.

16. The dipole permanent magnet structure of claim 15, wherein the magnetic flux density in the magnetic field increases linearly along the longitudinal axis in the direction of the distal end of the rectangular gap.

17. The dipole permanent magnet structure of claim 15, wherein the first and second pole pieces are made of a permeable magnetic material.

18. The dipole permanent magnet structure of claim 17, wherein the permeable magnetic material is 2V Permendur.

19. The dipole permanent magnet structure of claim 17, wherein the permeable magnetic material is Hiperco 50.

20. The dipole permanent magnet structure of claim 17, wherein the permeable magnetic material is low carbon steel.

21. The dipole permanent magnet structure of claim 15, wherein the first and second pole pieces are tapered in the direction of the rectangular gap to reduce fringing flux between the first and second pole pieces.

22. The dipole permanent magnet structure of claim 15, wherein the plurality of permanent magnets each having a magnetic field oriented to intensify the magnetic field in the rectangular gap increases the magnetic flux density of the magnetic field at the distal end of the rectangular gap so that the magnetic flux density of the magnetic field at the substantially distal end of the rectangular gap approaches the saturation flux density of the first and second pole pieces.

23. The dipole permanent magnet structure of claim 15, wherein the magnetic flux density of the magnetic field at the substantially distal end of he rectangular gap is greater than the residual flux density of the magnetic field of each of the plurality of permanent magnets.

24. The dipole permanent magnet structure of claim 15, wherein the rectangular gap has equilateral sides.

25. The dipole permanent magnet structure of claim 15, wherein the first and second permanent magnets and each of the plurality of permanent magnets is made of highly coercive magnet material.

26. The dipole permanent magnet structure of claim 25, wherein the first and second permanent magnet and each of the plurality of permanent magnets has a high saturation magnetization level.

27. The dipole permanent magnet structure of claim 26, wherein the highly coercive magnet material is rare earth permanent magnet material.

28. The dipole permanent magnet structure of claim 27, wherein the rare earth permanent magnet material is Samarium Cobalt.

29. The dipole permanent magnet structure of claim 27, wherein the rare earth permanent magnet material is Neodymium Iron Boron.

30. The dipole permanent magnet structure of claim 15, further comprising a permeable shell coupled to the first and second pole pieces, the first and second permanent magnets, and the plurality of permanent magnets, to reduce leakage flux.

31. The dipole permanent magnet structure of claim 15, further comprising a pair of capping magnets each capping the proximate end of the first and second pole pieces, the capping magnets having a magnetic field oriented to add by superposition to the magnetic flux density of the magnetic field in the rectangular gap and block leakage flux out of the proximate end of the first and second pole pieces.

32. The dipole permanent magnet structure of claim 31, further comprising a second pair of capping magnets each capping the proximate end of the first and second permanent magnets, the capping magnets having a magnetic field oriented to add by superposition to the magnetic flux density of the magnetic field in the rectangular gap and block leakage flux out of the proximate end of the first and second permanent magnets.

33. The dipole permanent magnet structure of claim 32, further comprising a third pair of capping magnets each capping the distal end of the first and second pole pieces, the capping magnets having a magnetic field oriented to add by superposition to the magnetic flux density of the magnetic field in the rectangular gap and block leakage flux out of the distal end of the first and second pole pieces.

34. The dipole permanent magnet structure of claim 33, further comprising a fourth pair of capping magnets each capping the distal end of the first and second permanent magnets, the capping magnets having a magnetic field oriented to add by superposition to the magnetic flux density of the magnetic field in the rectangular gap and block leakage flux out of the distal end of the first and second permanent magnets.

* * * * *